United States Patent [19]

Schnellbacher et al.

[11] 4,179,363

[45] Dec. 18, 1979

[54] DUAL-TABLE SEPARATING APPARATUS

[75] Inventors: Kurt Schnellbacher; Klaus Müller; Frank-Otto Görlitz, all of Braunschweig, Fed. Rep. of Germany

[73] Assignee: Bühler-Miag GmbH, Braunschweig, Fed. Rep. of Germany

[21] Appl. No.: 934,549

[22] Filed: Aug. 17, 1978

Related U.S. Application Data

[63] Continuation of Ser. No. 782,832, Mar. 30, 1977, abandoned.

[30] Foreign Application Priority Data

Apr. 2, 1976 [DE] Fed. Rep. of Germany ..... 2614247
Oct. 28, 1976 [DE] Fed. Rep. of Germany ..... 2648950

[51] Int. Cl.[2] ..... B07B 13/10
[52] U.S. Cl. ..... 209/481; 209/504
[58] Field of Search ..... 209/342, 504, 479–481, 209/471–472, 440–443, 437, 508, 365 R, 365 A, 365 B, 311, 313, 341

[56] References Cited

U.S. PATENT DOCUMENTS

| | | | |
|---|---|---|---|
| 565,812 | 8/1896 | Stoddard | 209/443 |
| 859,433 | 7/1907 | Christensen | 209/441 |
| 932,594 | 8/1909 | Streckel | 209/481 |
| 953,900 | 4/1910 | Dallemagne | 209/441 |
| 2,084,976 | 6/1937 | Puerner | 209/504 X |
| 2,191,504 | 2/1940 | Smith | 209/365 B X |
| 2,358,876 | 9/1944 | Overstrom | 209/504 X |

FOREIGN PATENT DOCUMENTS

| | | | |
|---|---|---|---|
| 966515 | 8/1957 | Fed. Rep. of Germany | 209/313 |
| 75220 | 7/1954 | Netherlands | 209/365 R |
| 114594 | 4/1918 | United Kingdom | 209/508 |
| 314481 | 11/1921 | U.S.S.R. | 209/311 |

*Primary Examiner*—Ralph J. Hill
*Attorney, Agent, or Firm*—Michael J. Striker

[57] ABSTRACT

A separating apparatus has a frame comprised of a stationary lower frame and a tiltable upper frame. A pair of longitudinally independently displaceable tables are spring-biased into respective central positions on the frame and are each displaceable in either longitudinal direction from these central positions. A drive assembly comprises an electric motor operatively connected to a crank pin that is rotated so as to move longitudinally relative to the frame. A link is connected between this crank pin on the front table and the rear table so that the two tables are moved oppositely longitudinally relative to each other when the motor operates. A stabilizer including a two-arm lever pivoted on the frame and having a pair of arms each connected via a respective stabilizing link to a respective table may be provided in the arrangement in order to insure that the strokes of the two tables remain at a fixed ratio to each other.

26 Claims, 13 Drawing Figures

IX
IX

DUAL-TABLE SEPARATING APPARATUS

CROSS-REFERENCE TO RELATED APPLICATION

This application is a continuation application of application Ser. No. 782,832, filed Mar. 30, 1977, and now abandoned.

BACKGROUND OF THE INVENTION

The present invention relates to a separating apparatus. More particularly this invention concerns a table separator for particulate material such as rice, oats, rye, corn and the like.

It is known to separate different sizes of particulate material, such as hulled rice grains from unhulled rice grains, by means of a separating table which is agitated. The table is normally tipped to the horizontal and the unseparated material is charged onto the table at the upper side. In such table separators the particles of said particulate material will be separated, e.g. unhulled rice grains from hulled rice grains, bei means of a plurality of separating chambers positioned on the said table and provided with zigg-zagged baffles, and in which the material is separated into a plurality of fractions by taking advantage of the way in which the material particles ricochet.

In such arrangements the throughput, that is the massive material separated per unit of time, is directly proportional to the rate of vibration of the table and the length of the stroke of the table each time it vibrates. Such machines invariably vibrate so greatly that they must be extremely ruggedly built and solidly anchored so that they do not literally shake themselves to pieces. Thus it is virtually impossible to mount such machines on anything but the ground floor, which must normally be reinforced in any case. This constraint is disadvantageous in many plant setups where the material flow is ideally from upper floors toward lower floors, so that after separating in such plants the material must be transported up before it can be processed. It is also noted that there is considerable energy wasted by such machines in vibrating their entire frames and all of the structure surrounding them.

It has been suggested to provide a pair of superposed screens each of which is provided with a rack extending parallel to the rack of the other screen and having teeth directed toward the teeth of the other screen. A gear wheel is provided between and in mesh with both of these racks and is mounted on the end of an oscillating arm driven from a crank on a motor that is fixed beneath the arrangement. Thus the one screen is moved in one direction as the other screen is moved in the opposite direction so that a limited amount of force equilization is obtained. Nonetheless the motor has considerable throw, so that the machine still vibrates considerably and must be extremely ruggedly built and securely mounted as described above.

SUMMARY OF THE INVENTION

It is therefore an object of the present invention to provide an improved separating apparatus for particulate material.

Another object is to provide such an apparatus which does not greatly vibrate surrounding structure.

Yet another object is the provision of a separating apparatus which need not be extremely heavily built and securely anchored for good operation.

These objects are attained according to the present invention in a separating apparatus for particulate material which comprises a frame defining a generally horizontal longitudinal direction. A front table and a rear table spaced longitudinally from the front table are supported on the frame for independent limited displacement in the longitudinal direction. Drive means is completely supported on the front table and has an output which is displaceable in the longitudinal direction and which is connected via a link to the rear table. Biasing means is provided for urging the two tables into central positions to each side of which they can move when reciprocated by the drive means.

Thus in accordance with the present invention a virtually completely closed force system is provided so that as the one table moves in one direction the other table will move in the opposite direction, to an extent completely cancelling out the motion of the first table so that although the two table can be vibrated at high speed over relatively long strokes, the frame of the apparatus will hardly vibrate at all. Thus it is possible for the apparatus to be run at extremely high speeds for maximum throughput, yet at the same time it is not necessary to extremely rigidly anchor the apparatus to the floor and form its various members of heavy bars and the like. Indeed it is possible to reduce the overall mass of the apparatus to a fraction so that energy costs to operate it are greatly reduced. Furthermore this reduction in mass allows the separating tables to be reciprocated at very high speeds so that a relatively small apparatus can have a throughput which was hitherto only obtainable with a much larger device.

According to further features of this invention the drive means includes an electric motor operatively connected to a crank pin so that the crank pin is continuously orbited at a predetermined angular rate about a crank axis perpendicular to the longitudinal direction of the arrangement. This motor along with the crank pin and various other elements of the drive are mounted underneath the front table so that the apparatus according to this invention takes up a minimal floor space. Furthermore means is provided for varying the orbiting speed of the crank pin about the crank axis, thereby allowing for adjustment of the reciprocation rate of the two tables. This speed-adjustment means can be a motor-speed control of the electronic type, a variable transmission, or any other well-known expedient. Furthermore means is provided for varying the radial spacing between the crank pin connected to the link secured at its rear end to the rear table and the crank axis. As this radial spacing is decreased the stroke, that is the longitudinal distance through which each table is moved, is decreased and vice versa. It is therefore possible to adjust this machine for the speed and stroke ideally suited for the material being separated.

The biasing means according to this invention comprises at least two compression springs for each table. Each spring is braced at one end against the respective table and at its other end against the frame, and the two springs for each table are oppositely braced so that they automatically center the respective table in the above-described center position. The force these springs exert and the number of springs is the same for each table, and the precompression of these springs can also be adjusted. In accordance with this invention each spring is housed in a sleeve-and-piston assembly similar to that of a vehicular shock absorber.

The frame according to this invention actually is constituted by a lower frame fixed to the floor, and an upper frame which carries the two separating tables and which can be tipped about a tipping axis parallel to the longitudinal direction of the apparatus. Jacks are provided between the upper and lower frames for tipping them relative to each other, both being tipped to the same extent at all times. Furthermore the tables are supported on the upper frame on rollers. In order to insure proper positioning of these tables the rollers to one side of each of the tables are formed with concave peripheries in which engage complementarily shaped guide rails on the tables. The rollers on the other side may have non-concave or rounded outer profiles and serve merely to support the respective side of the tables.

The apparatus comprises according to further features of this invention a counterweight on the rear table so that the overall mass of the rear table is virtually identical to that of the front table. Thus this counterweight has approximately the same mass as the drive means carried on the front table. In order to compensate for differences in mass between the two tables which will inherently occur during operation of the machine since the loading between the two tables will not be equal, or since the particulate mass on one table will be sifted more quickly than the other, the invention provides stabilizing means which couples the two tables longitudinally together in such manner that longitudinal displacement of the front table in one longitudinal direction through a predetermined first distance is matched by displacement of the rear table in the opposite longitudinal direction through a predetermined second distance bearing a fixed ratio to the first distance. In most cases this fixed ratio is 1:1, although the invention does provide means for varying the ratio. This stabilizing means in accordance with this invention includes a stabilizing element pivoted on the frame of the apparatus between the two tables and engaged with both of the tables. The stabilizing element may be a two-arm lever the end of each of whose arms is connected via respective rigid or spring-steel link to a respective table. It may also be constituted as a gear wheel meshing with a pair of racks each carried by a respective table. Means may be provided in the two-arm lever arrangement for displacing the lever relative to its pivot axis or for displacing either or both of the end pivots on the lever relative to the lever pivot axis.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
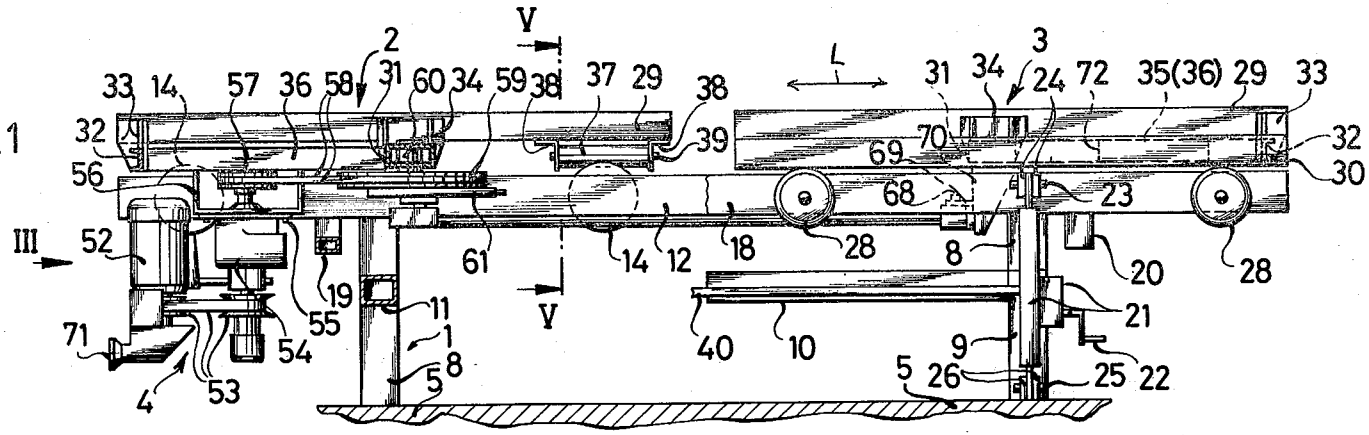
FIG. 1 is a side view partly in section showing the apparatus according to this invention.

DESCRIPTION OF THE PREFERRED EMBODIMENTS:

The apparatus shown in FIGS. 1–7 basically comprises a frame assembly 1 supporting a front separating table 2 and a rear table 3. A drive 4 is carried on the front table 2, and the frame assembly 1 is constituted by a lower frame 6 standing on the floor 5 and an upper frame 7 supported on the lower frame 6. The frame extends in a horizontal longitudinal direction shown by arrow L. The use of the terms "front" and "rear" are hereinafter merely used for simplicity of explanation, no restriction as to method of operation is intended thereby.

Figure 4:
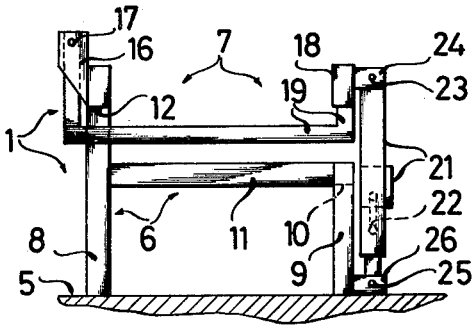
FIG. 4 is a view similar to FIG. 3 with some of the parts of the apparatus removed.
Figure 6:
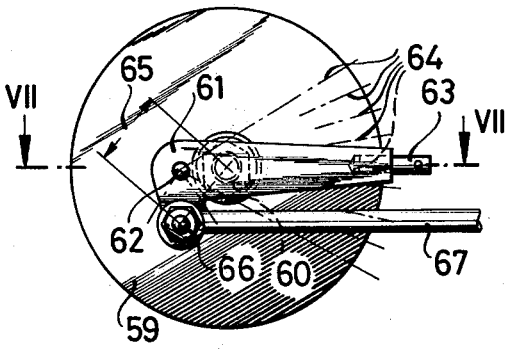
FIG. 6 is a large-scale top view of a detail of FIG. 2.
Figure 5:
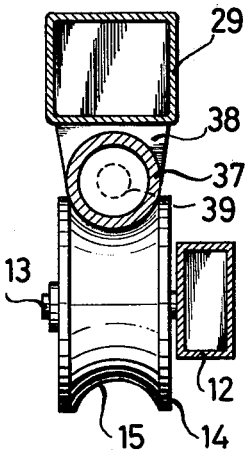
FIG. 5 is a large-scale sectional view along line V—V of FIG. 1.
Figure 7:
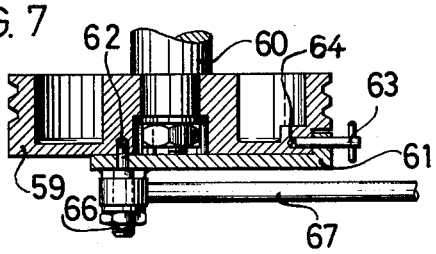
FIG. 7 is a section taken along line VII—VII of FIG. 6.

The lower frame comprises as best shown in FIG. 4 a pair of relatively tall parallel legs 8 on one side of the arrangement and standing on the floor 5 and a pair of relatively short legs 9 parallel thereto. A rectangular framework formed by a longitudinally horizontal beam 10 extending between the upper ends of the legs 9, by transverse beams 11 extending between each of the legs 9 and the respective leg 8, and by a further longitudinal beam 12 extending parallel to the beam 10 between the upper ends of the leg 8 makes the lower stationary frame extremely rigid. The beam 12 is positioned substantially higher than the beam 10 and is provided with four pivot pins or axles 13 each supporting as shown in FIG. 5 a respective wheel 14 formed at its outer periphery with a concave groove 15 of part-circular section. The pivots 13 extend horizontally perpendicular to the direction L and all lie in a common horizontal plane parallel to the direction L. Furthermore the beam 12 is provided between each of the outermost rollers 14 and the next inner roller 14 with a pair of flanges or plates 16 supporting a heavy pivot pin 17. These pins 17 extend coaxially parallel to the direction L.

The upper frame 7 is formed by a longitudinal beam 18 extending parallel to and directly above the beam 10 and by a pair of U-shaped transverse beams 19 and 20 open upwardly and each having one end welded to the beam 18 and another end received between a respective pair of the flanges 16 and pivoted on the respective axle or pivot pin 17. Thus the upper frame 7 constituted by members 18-20 can pivot relative to the lower frame formed by members 8-12 about a tipping axis formed by the pivots 17.

Figure 3:
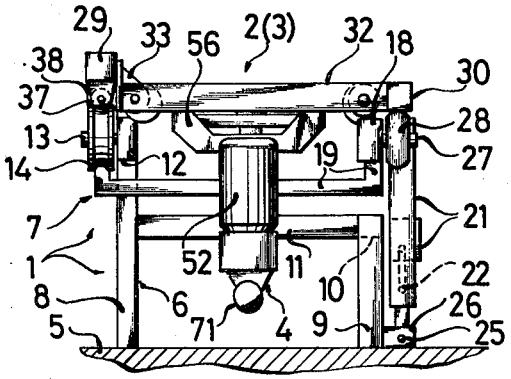
FIG. 3 is an end view taken in the direction of arrow III of FIG. 1.

As best shown in FIGS. 1, 3 and 4 a jack mechanism 21 is provided adjacent each of the legs 9 at each of the tables 2 and 3. At the table 3 the mechanism 21 is provided with an operating crank and a shaft 40 extending between the two mechanisms 21 serves to interconnect them and operate them synchronously. The upper end of each of the vertically extensible jack mechanisms 21 is connected to a pivot pin 23 passing through a pair of flanges 24 on the longitudinal beam 18 of the upper frame 7. The lower end of each of the jack mechanisms 21 is connected to a pivot pin 25 extending between a pair of flanges 26 provided on the respective short leg 9 of the lower frame 6. The pivot pins 25 are coaxial and parallel to the direction L and the pivot pins 23 are similarly coaxial and parallel to the direction L. Rotation of the crank 22 in one direction will therefore tip the entire upper frame 7 in one direction about the tipping axis defined by the pins 17 and rotation in the opposite direction will move it in the opposite angular direction relative to these pivot pins 17. The inclination of the tables 2 and 3 is determined by the inclination of the upper frame 7 relative to the lower frame 6.

The beam 18 is provided with four pivot pins 27 each defining a respective pivot axis lying in the same vertical plane as the axis of a respective one of the pins 13. It is possible for each of the pins 27 to be aligned coaxially to the respective pin 13 in an intermediate tipped position of the upper frame 7. Nonetheless as the upper frame 7 is tipped upwardly or downwardly from the illustrated central position of FIG. 3 the pivot pins 27 will move into and out of coaxial alignment with the respective pivot pins 13, but will always lie coplanar therewith. Each of the pins 27 supports a respective roller 28 of rounded or part-circular outer periphery. Thus each of the tables 2 and 3 is supported at one side on two rollers 14 and at the other side on two rollers 28.

Each of the tables 2 or 3 is basically constituted by a pair of longitudinal beams 29 and 30 each above and slightly outside of the beams 12 and 18. A large transverse beam 31 extends from a connecting plate 34 on each of the beams 29 and the other beam 30, and a lighter transverse beam 32 extends from a connecting plate 33 on each of the beams 29 to the corresponding end of the respective beam 30. Struts 35 and 36 extend longitudinally between the transverse beams 31 and 32. Thus each of the tables 2 and 3 is formed of a very rigid network of metal beams. These frameworks support a structure indicated schematically at 73 in FIG. 2, comprising a plurality of separating chambers each of which has an inclined bottom and ziggzagged baffles as well as catching channels for the lighter and heavier fractions of the separated material well known in the art not forming part of the present invention. Each of the beams 29 is provided with two pairs of longitudinally spaced mounting brackets 38 between which extend a respective pivot axle 39 on which is rotatable a respective tubular rail 37 shown in detail in FIG. 5 and of the same radius of curvature as the groove 15 of the rollers 14. Each of these tubular rails 37 rests in a respective roller 14 and can roll longitudinally thereon as well as rotate about a respective axis 39 coaxial with the axes defined by the pins 17 as seen by a comparison of FIGS. 3 and 4. The beams 30 rest on the non-concave peripheries of the rollers 28. Thus each of the tables 2 and 3 can be displaced limitedly longitudinally independently of the other table, and extension of the jack mechanism 21 will raise the rollers 28 so as to tip both of the tables 2 and 3 about the tipping axis defined by the pivot pins 17 and axles 39. Biasing means for the frameworks 29–36 constituting the tables 2 and 3 are formed by two compression springs 41 urging each of the tables 2 and 3 in one longitudinal direction and two compression springs 42 urging the tables 2 and 3 in the opposite longitudinal direction. These srings 41 and 42 are so adjusted as normally to hold the tables 2 and 3 in center positions shown in FIGS. 1 and 2. Each of these springs 41 and 42 is surrounded by and braced in one direction against a sleeve 43 and bears in its opposite direction against a plate or piston 44. The sleeve 43 of each spring 41 is connected via a respective threaded rod 45 and nut 46 to a bracket or holder 47 on the respective table 2 or 3. The plate 44 of each spring 41 is connected via a threaded rod 48 and a nut 49 to a bracket or holder 50 which is welded to the beam 12. The nuts 49 and 46 can be used to adjust these springs 41. The sleeve 43 of each of the springs 42 is also provided with a threaded rod 45 and nut 46 that is connected to a bracket or holder 51 on the longitudinal beam 18 of the frame 7. The plate 44 of each of the springs 42 is also connected via a threaded rod 48 and nut 49 to the transverse beam 32 of the respective table 2 or 3.

The drive 4 carried on the front table 2 basically comprises an electric motor 52 having a member 71 adjustable to vary its speed, and connected via a V-belt drive 53 to the input of a transmission 54 secured via bolts 55 to a plate 56 itself bolted between the struts 35 and 36 of the front table 2. The output of this transmission 55 carries a pulley 57 connected via a belt 58 to a pulley 59 carried on a shaft 60 journalled in the transverse beam 31 of the table 2. This pivot 60 is vertical and perpendicular to the direction L. A crank element 61 is pivotal on a pin 62 parallel to but radially offset from the axle 60. This crank 61 in turn carries a crank pin 66 whose radial spacing 65 from the axis defined by the shaft 60 can be varied by pivoting the crank 61 about the axis 62. A latch 63 engageable in a plurality of radially spaced holes 64 in the periphery of the pulley 59 defines a plurality of positions for the crank 61. In each position of the crank 61 the spacing 65 is different, so that the displacement relative to the direction L of the crank pin 66 can be adjusted with some fineness.

Figure 2:
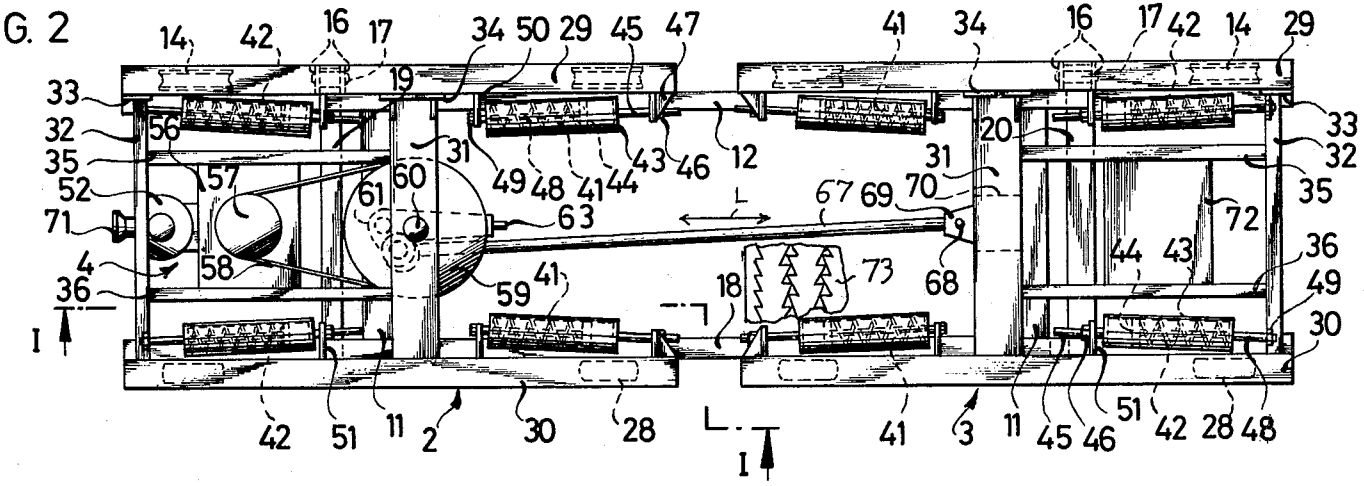
FIG. 2 is a top view of the apparatus shown in FIG. 1, some parts being removed for clarity of view, line I—I of FIG. 2 being the section line for FIG. 1.

A rigid link rod 67 has a front end pivoted on the pin 66 and a rear end pivoted on a bolt 68 carried on a horizontally extending flange 60 projecting from a downward extension 70 on the transverse beam 31 of the rear table 3 as shown in FIG. 2. Thus the drive means is linked to the table 3. A counterweight 72 is mounted between the struts 35, 36 and has a mass substantially equal to that of the elements 52–66. In operation the motor 52 rotates the pulley 59 which acts in part as a flywheel at an angular speed determined by the setting of the adjustment member 71. This causes the pin 66 to rotate at a predetermined rate about the axle 60, thereby displacing the link 67 longitudinally through a distance equal to twice the radial spacing 65. Since the table 3 is provided with a counterweight generally equal in mass to the drive 4 and since the springs 41 and 42 are substantially equal the tables 2 and 3 will move apart as the pivot 66 is moved towards the table 3 and together as it is moved away from the table 3. Since the change in direction of displacement of the link 67 takes place over a relatively wide arc, each of the tables 2 and 3 is gently brought to a stop and reversed without undue shock to the entire system. Thus it is possible to operate with relatively high speeds and relatively great strokes equal to twice the distance 65 and determined by the setting of the crank 61.

Since for each displacement in one direction of each of the tables 2 and 3 the other table moves in the opposite direction the entire assembly can be built of relatively light construction. The overall machine weight can be reduced by as much as one-quarter, so that it is possible to operate at higher speeds and with longer strokes. Furthermore the machine need not be securely anchored to the floor in order to prevent it from damaging itself with vibration, and indeed can even be mounted in upper stories of a building if desired.

The three factors determining throughput—reciprocation frequency, stroke length and table tilt—are all determined according to the type of particulate material being separated. It is therefore possible to use the machine according to this invention with many different kinds of particulate material and achieve equally good results with all. The changeover from one type of material to another is relatively simple, merely requiring the tilt to be adjusted by means of the jack handle 22, the frequency by means of the adjustment member 71 and the stroke by means of the latch 63.

FIGS. 8–12 show another arrangement according to this invention. This machine basically comprises a frame structure 101 supporting two tables 102 and 103 relatively displaceable by means of a drive 104. A lower frame 106 is supported on the floor 105 and an upper frame 107 is tippably supported via pivots 108 on the lower frame 106. Jacks 109 adjust the tilt angle of the upper frame 107. This frame 107 has guide tubes 110 supported in grooved rollers 111 and is also supported via round rollers 112 in much the same manner as the arrangement of FIGS. 1–7.

The drive 104 comprises an electric motor 113 mounted on the table 102 and carrying a pulley 114 connected by means a V-belt 116 to another pulley 115 connected via a transmission to a pulley 117 itself connected by means of a V-belt 119 to a pulley 118 functionally identical to the pulley 59 of FIGS. 1–7. This pulley 119 carries a crank 120 connected via a rod 121 to the cross member of the table 103.

Centering springs 122 and 123 are braced between abutments 124 and 125 on the frame 101 and tables 102 and 103 and function the same as the springs 41 and 42 of FIGS. 1–7.

The separating apparatus of FIGS. 8–12 differs principally from that of FIGS. 1–7 in that it is provided with a stabilizer 126 having a two-arm stabilizing lever 127 pivoted on the frame 101 at a vertical axle 128 fixed on a cross member 129 of the frame 101. Thus the axis defined by the pivot 128 is fixed on the frame 101 and the tables 102 and 103 move relative to it.

This lever 127 has arms **127*a* and 127*b* on which are pivoted spring-steel links 130 and 131 secured via mounts 132 and 133 on the tables 102 and 103**, respectively.

Thus as the motor 113 rotates the wheel 118 the crank 120 will be effective via the link 121 to displace the tables 102 and 103 oppositely. The stabilizer mechanism 126 will insure that displacement of one of the tables 102 or 103 in one direction will be exactly matched by displacement of the other table in the opposite direction, so long as the effective lengths x and y of the arms **127*a* and 127*b***, respectively, are the same.

Figures 8, 9, 10, 11, 12, 13:
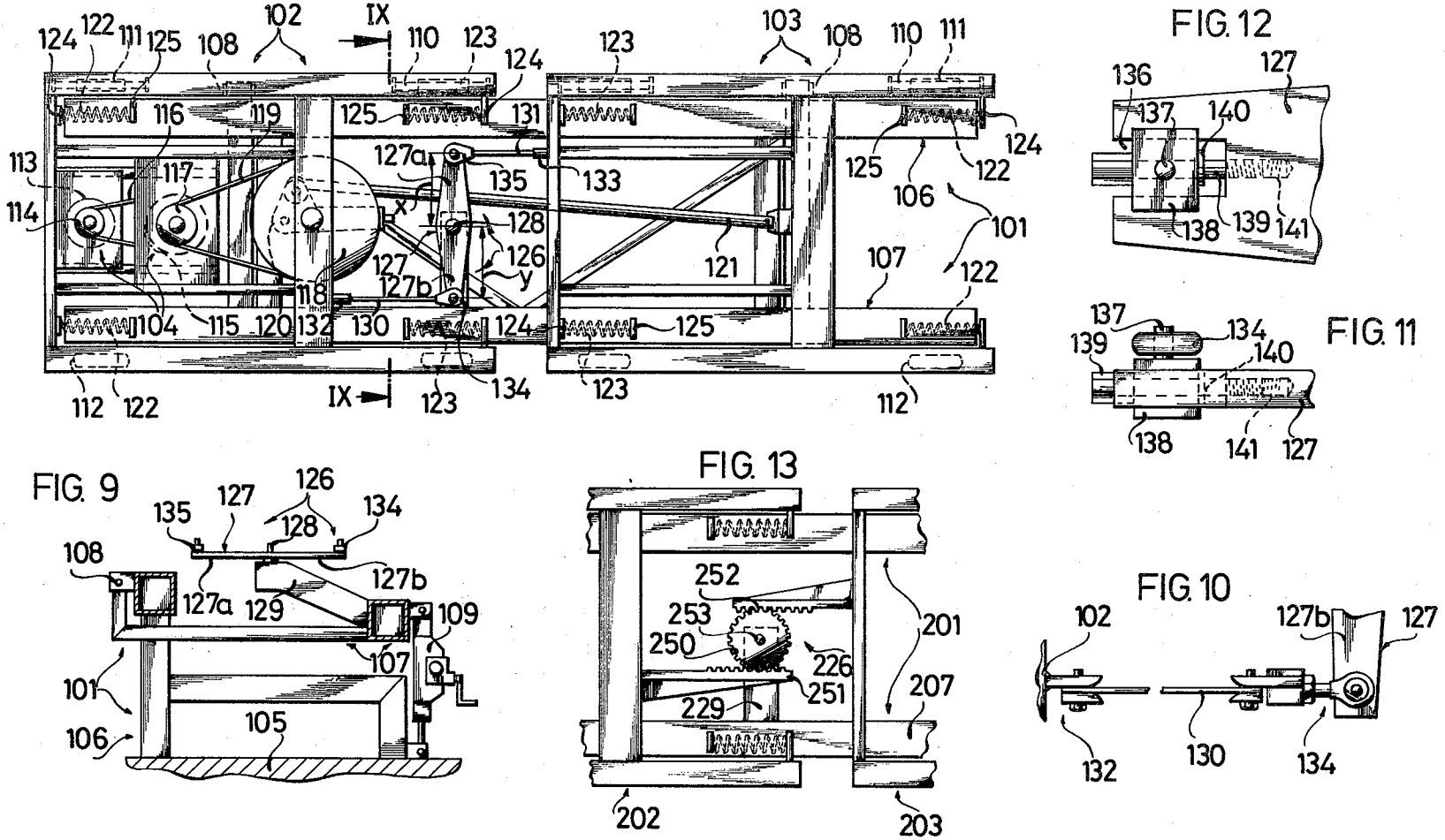
FIG. 8 is a view similar to FIG. 2 showing a variation on the apparatus according to this invention.
FIG. 9 is a section taken along line IX—IX of FIG. 8.
FIG. 10 is a large-scale view of a detail of FIG. 8.
FIG. 11 is a large-scale side view of a detail of FIG. 8.
FIG. 12 is a top view of the detail of FIG. 11.
FIG. 13 is a top view corresponding to a portion of FIG. 8 showing another variation on the apparatus according to this invention.

FIGS. 11 and 12 show how each end of the lever 127 can be formed with a slot 136 open away from the pivot 128 and receiving a slidable block 138 provided with a pivot pin 137 for an end 134 or 135 of one of the links 130 or 131. A screw 139 is threaded in a bore 141 extending radially in the lever 127 from the pivot 128 and is axially fixed to the block 138 by means of a snap ring 140. Thus rotation of the screw 139 will displace the pivot 137 relative to the pivot 128 and thereby change the respective effective lengths x or y.

Either or both of the links 130 and 131 may be so connected to the lever 127, and similarly the pivot 128 may be displaceable in the same manner longitudinally of the lever 127 for simultaneous adjustment of both of the effective lengths x and y.

The above-described stabilizing arrangement serves to maintain the strokes of the two tables 102 and 103 at a fixed ratio to each other even when one of the tables is much heavier than the other due to overloading or the like. Normally if one table is greatly overloaded relative to the other it is possible for this table to remain virtually at a standstill while the other table reciprocates through twice the distance it normally would reciprocate through. Thus with this arrangement inequalities in feed rate can readily be compensated for.

FIG. 13 shows another stabilizing arrangement 226 which basically comprises a gear wheel 250 secured on a pivot 253 of a cross member 229 extending from a longitudinal beam 207 of the frame 201 of a separating apparatus having tables 202 and 203. The tables 202 and 203 carry respective racks 251 and 252 which mesh with opposite sides of the gear wheel 250 for exactly equal but opposite displacement of these two tables 202 and 203 relative to each other.

Thus with the apparatus according to the present invention it is possible to achieve very good separating with a relatively small and light-duty arrangement. The various factors affecting separating capacity are all easily adjustable and the machine can readily be mounted without providing reinforced flooring and the like to absorb external vibration.

It will be understood that each of the elements described above, or two or more together, may also find a useful application in other types of machines differing from the types described above.

While the invention has been illustrated and described as embodied in a separating apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A separating apparatus for particulate material, especially for separating shelled grain from unshelled grain in dependence on the different elasticity of these grains, said apparatus comprising a frame defining a generally horizontally longitudinal direction; a front separating table on said frame; a rear separating table on said frame spaced longitudinally from said front table, each of said tables being provided with a plurality of separating chambers extending transverse to said direction and each having an inclined bottom and zig-zag baffles; means supporting said tables on said frame for independent linear displacement only in said longitudinal direction; a link extending at least generally in said direction and having a rear end connected to said rear table and a front end; biasing means for each of said tables for urging the same into a respective rest position; drive means completely supported on said front separating table and having an output end connected to said front end and limitedly reciprocable in said direction relative to said front separating table for limitedly longitudinally displacing said link and thereby oppositely longitudinally and linearly displacing said tables; a counterweight on said rear separating table dimensioned so that the mass of said front separating table including said drive means is substantially equal to that of said rear separating table including said counterweight; and stabilizing means including a stabilizing element secured to said frame for coupling said tables longitudinally together in such a manner that longitudinal displacement of said front table in one longitudinal direction through a predetermined first distance is matched by displacement of said rear table in the opposite longitudinal direction through a predetermined second distance bearing a fixed ratio to said first distance.

2. The apparatus defined in claim 1, wherein said drive means is suspended under said front table.

3. The apparatus defined in claim 1, wherein said drive means includes a crank pin constituting said output and a drive motor for orbiting said pin about a crank axis transverse to said direction and fixed relative to said front table.

4. The apparatus defined in claim 3; further comprising means for varying the spacing between said crank pin and said crank axis, whereby the strokes of said tables in said directions can be adjusted.

5. The apparatus defined in claim 3; further comprising means for varying the speed with which said pin orbits about said crank axis.

6. The apparatus defined in claim 3, wherein said link is a rigid rod extending between said pin and said rear table.

7. The apparatus defined in claim 1, wherein said stabilizing element is a gear wheel pivoted on said frame about a stabilizing axis transverse to said direction, said stabilizing means further including a pair of rack each carried on a respective table and extending in said direction in mesh with said gear wheel.

8. The apparatus defined in claim 1, wherein said biasing means includes at least one front spring braced between said frame and said front table and at least one rear spring braced between said frame and said rear table.

9. The apparatus defined in claim 8, wherein said springs bear with approximately the same spring force against the respective tables.

10. The apparatus defined in claim 8, wherein said biasing means includes two such front springs bearing in opposite longitudinal directions on said front table and two such rear springs bearing in opposite longitudinal directions on said rear table.

11. The apparatus defined in claim 1; further comprising means for tipping each of said tables about a generally horizontal and longitudinally extending tipping axis and for fixing the tables in any of a plurality of angularly offset positions relative to said tipping axis.

12. The apparatus defined in claim 11, wherein said tipping means is connected to both of said tables for jointly tipping same to the same extent about said tipping axis.

13. The apparatus defined in claim 12, wherein said frame includes a lower substantially stationary frame and an upper frame carrying said table and pivotal on said lower frame about said tipping axis, said means for tipping being operative between said upper and lower frame.

14. The apparatus defined in claim 13, said means supporting said tables includes a plurality of rollers rotatable on said upper frame about respective axes thereon transverse to said longitudinal direction and said tipping axes, said tables resting on said wheels.

15. The apparatus defined in claim 14, wherein said tables and at least two respective rollers are complementarily shaped for longitudinal guiding of said tables on said rollers.

16. The apparatus defined in claim 14, wherein said rollers include two front rollers for said front table and two rear rollers for said rear table aligned in said longitudinal direction, said front and rear rollers having outwardly concave peripheries and said tables having rails extending longitudinally and received in said peripheries.

17. The apparatus defined in claim 16, wherein said rails are rotatable about a rail axis parallel to said longitudingal direction.

18. The apparatus defined in claim 16, wherein said rollers includes two further front rollers and two further rear rollers with non-cave peripheries, said table having a further rail extending longitudinally and engaging said non-cave peripheries, said rails being parallel and spaced.

19. The apparatus defined in claim 1, wherein said drive means includes an electric motor fixed to said front table and jointly longitudinally displaceable therewith.

20. The apparatus defined in claim 1, wherein said distances are equal.

21. The apparatus defined in claim 1, wherein said stabilizing means includes a plurality of rigid levers connected to said tables and to said stabilizing element.

22. The apparatus defined in claim 1, wherein said stabilizing element is a two-arm lever pivoted on said frame about a stabilizing axis transverse to said direction, said stabilizing means including two stabilizing links each connected between a respective table and a respective arm of said lever.

23. The apparatus defined in claim 22; further comprising a pivot on one of said arms for one of said stabilizing links and means for displacing and fixing said pivot relative to said stabilizing axis, whereby the effective length of said one arm can be adjusted.

24. The apparatus defined in claim 22, wherein said stabilizing means includes means for varying the effective length of at least one of said arms.

25. The apparatus defined in claim 22, wherein said stabilizing means includes means for displacing said lever non-pivotally relative to said stabilizing axis and thereby varying said ratio.

26. The apparatus defined in claim 22, wherein said stabilizing links are elongated spring-steel elements.

* * * * *